United States Patent [19]

Junghans et al.

[11] 3,976,007

[45] Aug. 24, 1976

[54] WASHING DEVICE ADJUSTABLE WITH RESPECT TO THE BLANKET CYLINDER

[75] Inventors: Rudi Junghans, Wilhelmsfeld; Ernst Czotscher, Neckargemund, both of Germany

[73] Assignee: Heidelberger Druckmaschinen Aktiengesellschaft, Heidelberg, Germany

[22] Filed: June 24, 1974

[21] Appl. No.: 482,420

[30] Foreign Application Priority Data

June 22, 1973 Germany ..... 2331645

[52] U.S. Cl. ..... 101/425; 15/256.52; 101/142

[51] Int. Cl.[2] ..... B41F 35/06

[58] Field of Search ..... 101/425; 15/256.52

[56] References Cited

UNITED STATES PATENTS

| | | | |
|---|---|---|---|
| 861,605 | 7/1907 | Owens | 101/425 |
| 951,489 | 3/1910 | Saxton | 101/425 |
| 1,196,438 | 8/1916 | Doyle et al. | 101/425 |
| 2,341,020 | 2/1944 | Curtis | 101/425 X |
| 2,731,916 | 1/1956 | Koch | 101/425 |
| 3,656,200 | 4/1972 | Riley | 101/425 X |

FOREIGN PATENTS OR APPLICATIONS

| | | | |
|---|---|---|---|
| 1,169,668 | 11/1969 | United Kingdom | 101/425 |
| 222,988 | 10/1924 | United Kingdom | 101/425 |

*Primary Examiner*—Clyde I. Coughenour
*Attorney, Agent, or Firm*—Herbert L. Lerner

[57] ABSTRACT

In a washing device for an offset printing press having a blanket cylinder, the washing device being adjustable with respect to the blanket cylinder and including a rotary washing roller having a soft covering and being in frictional driving engagement with and traversible relative to the blanket cylinder, means for wetting the washing roller with wash solution, a collecting vessel underlying the washing roller, a doctor roller having a firm surface located in continuous frictional engagement with the washing roller, a doctor blade abutting the firm surface of the doctor roller for guiding therefrom into the collecting vessel ink washed off the blanket cylinder with the wash solution, and a distributor roller having a firm surface engaging the soft covering of the washing roller at a location behind the doctor roller in the rotary direction of the washing roller, the distributor roller being wettable with fresh wash solution; the means for wetting the washing roller with wash solution including a drip tube mounted above the distributor roller and extending along substantially the entire length thereof, the drip tube having nozzles, indexing means for pivotal movement, and valve means. The washing device also is provided with a rocking frame and adjustment means including spring and stop means.

2 Claims, 5 Drawing Figures

WASHING DEVICE ADJUSTABLE WITH RESPECT TO THE BLANKET CYLINDER

The invention relates to a washing device adjustable with respect to the blanket cylinder of an offset printing press. More specifically, the invention relates to such a device having a rotary washing roller with a soft covering which is in frictional driving engagement with and traversible relative to the blanket cylinder, means for wetting the washing roller with wash solution, a collecting vessel underlying the washing roller, a doctor roller having a firm surface located in continuous frictional engagement with the washing roller, a doctor blade abutting the firm surface of the doctor roller for guiding therefrom into the collecting vessel ink washed off the blanket cylinder with the wash solution, and a distributor roller having a firm surface engaging the soft covering of the washing roller at a location behind the doctor roller in the rotary direction of the washing roller, the distributor roller being controllably wettable with fresh wash solution. A washing device of the foregoing general type is described in copending application Ser. No. 470,946 filed May 17, 1974 of R. Junghans, which is a continuation of application Ser. No. 308,341 filed Nov. 21, 1972, now abandoned, and assigned to the same assignee as that of the instant application.

It is an object of the invention to provide such a washing device with a more simplified construction than that of the hereinbefore noted device of the same general type, as well as a construction that will afford a more reliable operation thereof.

With the foregoing and other objects in view, there is provided, in accordance with the invention, a drip tube mounted above the distributor roller and extending along substantially the entire length thereof, the drip tube having a plurality of nozzles formed with nozzle openings, indexing means operatively connected to the drip tube for pivoting the tube about the longitudinal axis thereof into three indexing positions, and vlave means similarly adjustable by the indexing means for regulating flow of the wash solution to the distributor roller in accordance with the respective indexing position of the drip tube.

By pivoting the drip tube while simultaneously adjusting the valve means, it is possible, in a relatively simple manner, to start and stop the feed of the wash solution. Since the drip tube remains adequately filled in each of the indexing positions, there are no delays or irregularities in the application of the wash solution. The particular advantage of the device of the invention in the instant application over the heretofore known device of this general type is that seals or other wearing parts have been rendered superfluous.

In accordance with another feature of the invention, the washing device includes indexing shaft means turnable about the longitudinal axis thereof, and an adjusting shaft for the valve means, the indexing means comprising three mutually meshing gears respectively mounted on the indexing shaft means, the adjusting shaft for the valve means, and the drip tube.

Since the blanket cylinder is adjustable to various thicknesses of paper to be imprinted by the offset printing press, and the position thereof is consequently slightly altered thereby, in accordance with a further objective of the invention, the contact pressure between the washing roller and the blanket cylinder is kept constant. With this objective in view, the washing device of the invention is provided with rocking frame means supporting the rollers and having a stop rib, and adjusting screw means having a plunger engageable with the stop rib so as to press the washing roller supported by the rocking frame against the blanket cylinder, the plunger being formed with a shoulder, and the adjusting screw means having spring means, such as a set of plate springs, in biasing engagement with the shoulder of the plunger. The characteristic curve of plate spring set can be kept so flat that the contact pressure within the adjustment range of the blanket cylinder is virtually unaltered.

Other features which are considered as characteristic for the invention are set forth in the appended claims.

Although the invention is illustrated and described herein as embodied in washing device adjustable with respect to a blanket cylinder of an offset printing press, it is nevertheless not intended to be limited to the details shown since various modifications and structural changes may be made therein without departing from the spirit of the invention and within the scope and range of equivalents of the claims.

The construction and method of operation of the invention, however, together with additional objects and advantages thereof will be best understood from the following description of a specific embodiment when read in connection with the accompanying drawings, in which.

Figure 1:
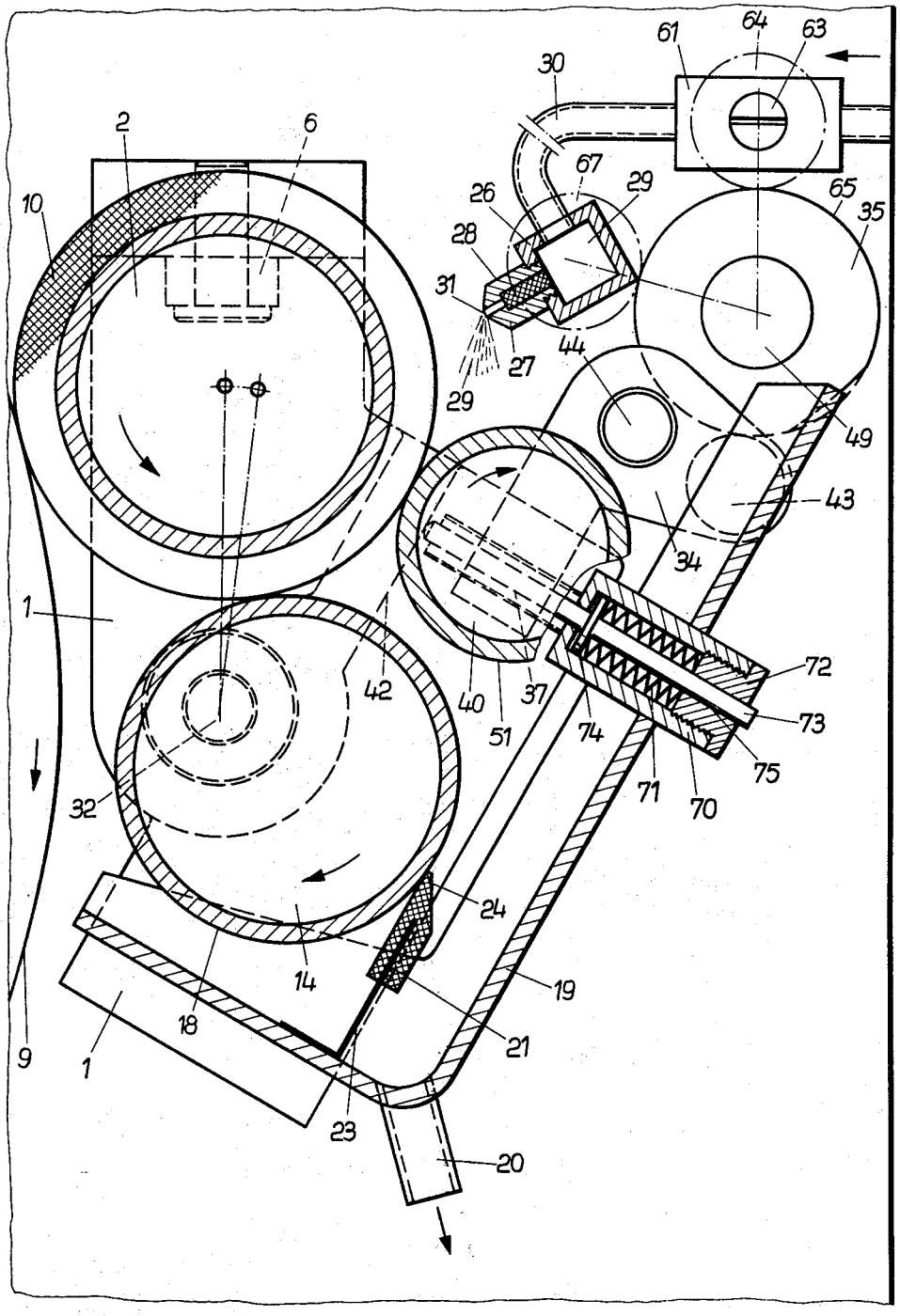
FIG. 1 is a vertical sectional view of a washing device for a blanket cylinder of an offset printing press according to the invention, wherein the washing device is in wash position.
Figure 2:
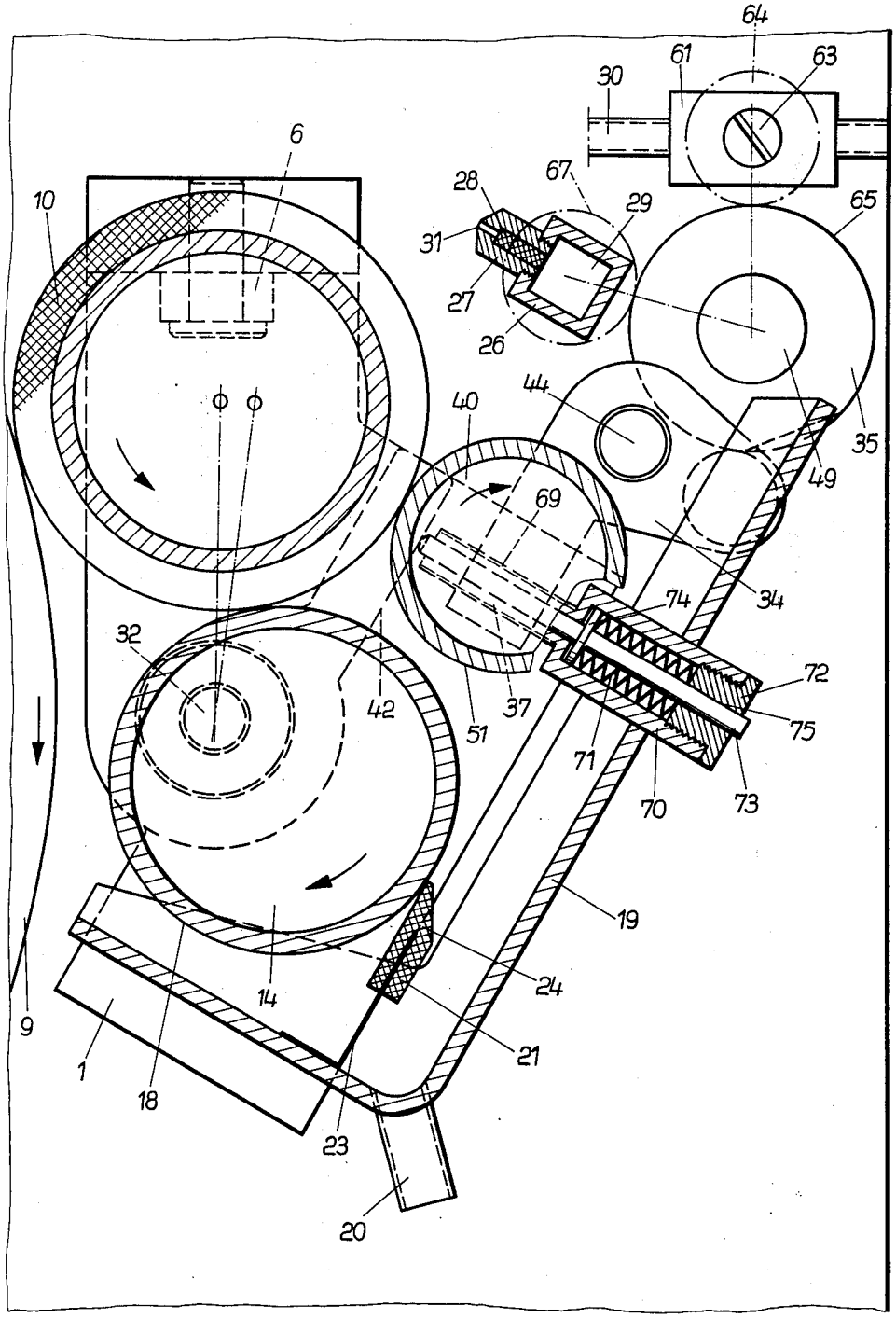
FIG. 2 is another view similar to that of FIG. 1 showing the washing device in dry position.
Figure 3:
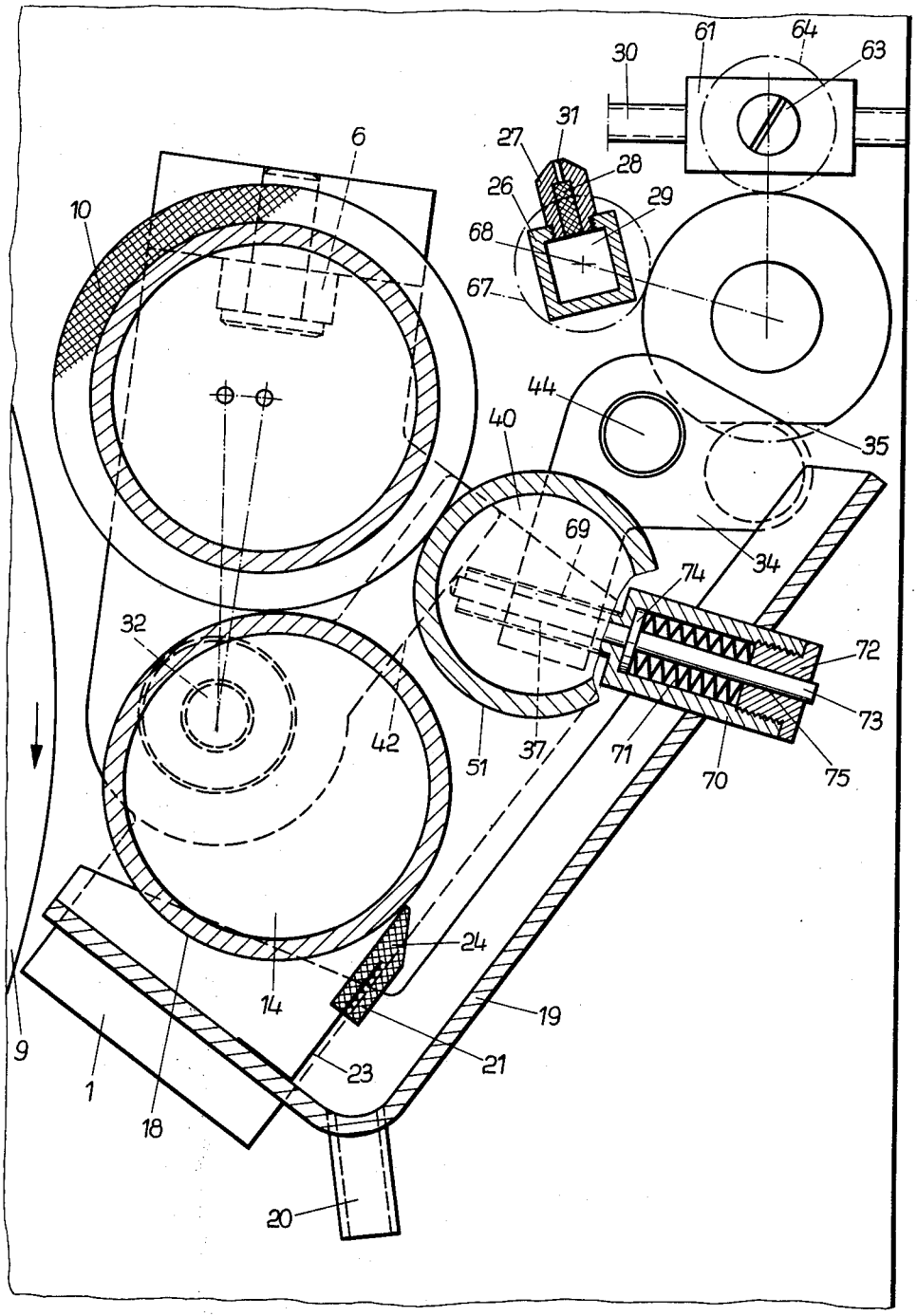
FIG. 3 is still another view similar to those of FIGS. 1 and 2 showing the washing device in neutral position.
Figure 4:
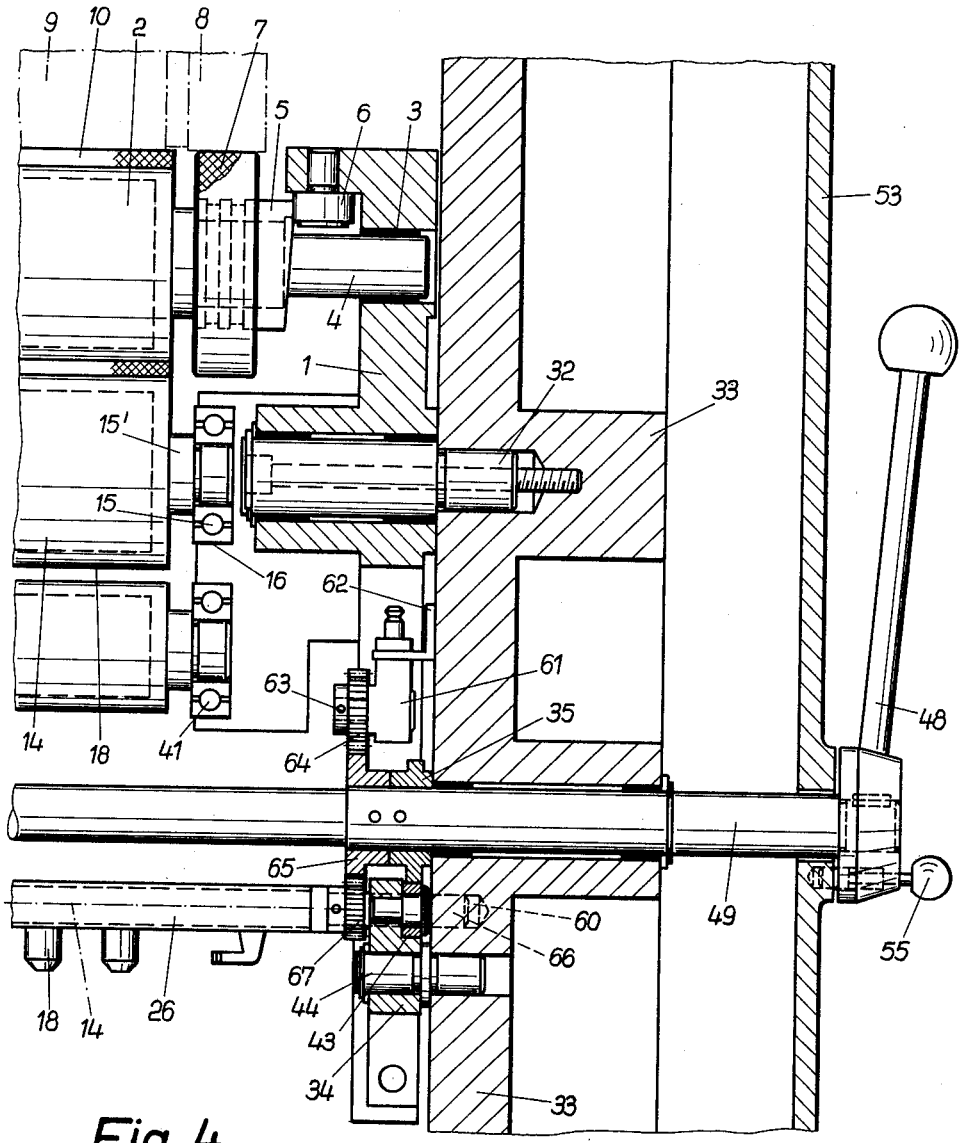
FIG. 4 is a partial longitudinal sectional view of FIGS. 1 to 3 from which several of the parts shown in the plane of the section of FIGS. 1 to 3 have been omitted in the interest of clarity.

Referring now first to FIGS. 1 to 3 and particularly to FIG. 4, there is shown therein a washing roller 2 which is traversibly mounted by two needle bearings 3 in a rocking frame 1. A cam 5 is secured on a shaft 4 of the washing roller 2 and runs against a roller 6 which is rotatably mounted on the rocking frame 1. A respective rubber raceway 7 is located on the shaft 4 at each side of the washing roller 2. Both rubber raceways 7, in the operating position of the washing device of the invention as shown in FIG. 4, for example, are in frictional engagement with respective opposing Schmitz rings or cylinder bearers 8 of a blanket cylinder 9 of an offset printing machine. As is generally known, Schmitz rings are located, for example, at the axial ends of the blanket cylinder. Depending upon the compressive load, they are formed of cast iron or hardened steel. For further details regarding the construction and installation of Schmitz rings or cylinder bearers and the operation thereof, reference can be made, for example, to U.S. Pat. No. 3,049,996 of R. H. Downie. The diameter of the rubber raceways 7 is about 1 mm. greater than that of the soft covering 10 of the washing roller 2.

A doctor roller 14 is mounted by means of ball bearings 15 in the rocking frame 1 parallel to the washing roller 2. The ball bearings 15 are located in guiding grooves 16 and are displaceable in direction toward the washing roller 2. The compressive force between a firm or hard jacket 18 of the doctor roller 14 and the soft cover 10 of the washing roller 2 is adjustable through the displaceable ball bearings 15 and the shaft 15' with the aid of non-illustrated adjusting or set screws.

Another roller, namely a distributor roller 40, is located above the doctor roller 14. The distributor roller 40, as viewed in rotary direction of the washing roller 2, is located behind the doctor roller 14, and has a firm or hard jacket 51, similarly. The distributor roller 40 is journalled in ball bearings 41 which are mounted so as to be displaceable in guiding grooves by nonillustrated adjusting or set screws. By displacing the ball bearings 41, the firm or hard jacket 51 of the distributor roller 40 is compressible with varying strength against the soft cover 10 of the washing roller 2.

A collecting vessel 19 screens all three aforedescribed rollers 2, 14 and 40 so that stripped-off ink or flung-off wash solution is collected therein. At the deepest location of the collecting vessel 19, it is provided with a discharge tube 20 through which the washed-off ink together with used wash solution can flow off into a larger container. Within the collecting vessel 19, there is located a doctor blade 21 which is formed of a leaf spring 23 and a rubber blade or scraper 24. The leaf spring 23 is firmly secured to the inner wall surface of the collective vessel 19. The rubber scraper or blade 24 abuts the hard or firm jacket 18 of the doctor roller 14 under light pressure. The jacket 18 may be covered with a hard material such as the material known by the trade name Rilsan or can, alternatively have a copper surface layer.

Above the distributor roller 40, a drip tube 26 extends parallel to and along the entire length of the washing roller 2. The drip tube 26 is journalled at both ends thereof with respective slide bearings 60 in the machine frame 33 of the offset printing press so as to be rotatable about the longitudinal axis thereof. The underside of the drip tube 26 is provided with a plurality of drip nozzles 27 which are disposed in row, spaced for example 50 mm apart. The drip nozzles 27 may be unscrewed from the drip tube 26, and contain a filter insert 28 of felt or any other suitable permeable material. The permeability of the filter insert 28 determines the flow-through rate of the wash solution present in the drip tube 26. The wash solution 29 is supplied from a non-illustrated container to the drip tube 26 through a feed tube 30.

The feed tube 30 is interrupted by a valve 61 by which the feed of wash solution 29 is regulatable. The valve 61 is firmly connected to the frame 33 by an angle bracket 62. An ajusting pinion 64 which is in meshing engagement with an indexing gear 65 is mounted on an adjusting shaft 63 of the valve 61. The indexing gear 65 is securely mounted on a control shaft 49. On one of a pair of shaft journals 66 provided at the ends of the drip tube 26, a swivel pinion 67 is additionally disposed and meshes with the indexing gear 65. Directly at the inside of both walls of the frame 33, a respective swivel cam 35 is mounted on the control shaft 49 and controls an adjusting member 34 through the intermediary of a cam follower 43. The adjusting member 34 is in the form of a bellcrank, which carries rotatably at one lever end thereof the cam follower 43, and at the other lever end thereof an adjusting screw 37 which is threadedly received in a threaded bore 69. The adjusting screw 37 has a free portion constructed as a spring cage or sleeve 70 and contains a plate spring set 71 which may be prestressed or preloaded. The spring cage 70 is closed by a guide cover 72 at one end thereof. A plunger 73, which is provided with a shoulder 74 abutting the plate spring set 71, extends through the entire adjusting screw 37, the point or end of the plunger 73 engaging a stop rib 42 of the aforementioned rocking frame 1. The other end of the plunger 73 projects through a guide bore 75 formed in the guide cover 72. The plunger 73 is displaceable against the biasing force of the plate spring set 71 in longitudinal direction of the adjusting screw 37.

The spring-loaded plunger 73 of the adjusting screw 37 is supposed to function so that the contact pressure between the wash roller 2 and the blanket cylinder 9 is maintained as constant as possible. If the position of the blanket cylinder 9 were, for example, altered with respect to the washing device because the printing mechanism has been adjusted for a different paper thickness, the travel path of the plunger 73 will suffice to maintain the aforementioned contact pressure because the characteristic curve of such a plate spring set 71 is exceptionally flat.

The adjusting member 34 is pivotally mounted by a bearing pin 44 in the frame wall 33. The rocking frame 1 is similarly pivotally supported on both sides rotatably on a bearing pin 32 in the frame 33 of the offset printing press. By rocking the adjusting member 34, the rocking frame 1 can be reciprocably swung about the bearing pin 32 through a given angle of rotation so that the soft cover 10 of the washing roller 2 comes into engagement with the rubber cloth of the blanket cylinder 9 or is again disengaged therefrom.

Figure 5:
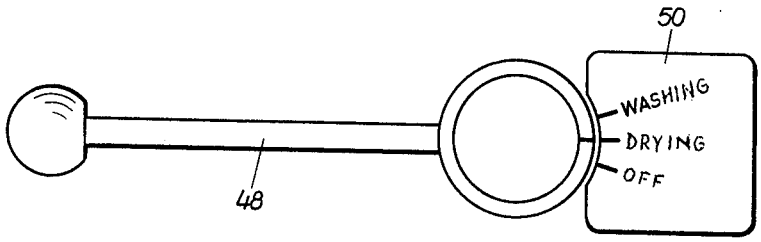
FIG. 5 is a view of a detail of FIG. 4 as seen from the right-hand side thereof.

At the operator's side of the offset printing press, a control lever 48 is secured at a free end of the control shaft 49 which extends through a casing 53. The control lever 48 is adjustable to three control positions which are indexed by a drop-in pin 55. In FIG. 5, the control lever 48 is shown in lateral view, coordinated with a scale 50 marked with the positions "Washing," "Drying" and "Off."

The operation of the aforedescribed washing device is as follows:

The blanket cylinder 9 is brought into non-printing position for the purpose of washing the same. Then the control lever 48 is swung into the control position "Washing." In doing so, the valve 61 is opened by the indexing gear 65 and the adjusting pinion 64. Moreover, the drip tube 26 is swiveled by the indexing gear 65 through the swivel pinion 67 into the position thereof shown in FIG. 1, so that wash solution 29 drips out of the nozzle openings 31 of the drip tube 26.

Simultaneously, through the rocking cam 35, the cam roller follower 43, the adjusting member 34 and the set screw 37, the rocker frame 1, is rocked counter-clockwise, as viewed in FIG. 1, until the soft cover 10 of the washing roller 2 engages the surface of the blanket cylinder 9. While wash solution then drips onto the distributor roller 40 from the nozzle openings 31, the blanket cylinder 9 sets the washing roller 2, the doctor roller 14 and the distributor roller 40 into rotation by mutual frictional contact. The dripping wash solution 29 is transported by the distributor roller 40 in clockwise direction as viewed in FIG. 1, for example, into the gap or nip between the washing roller 2 and the distributor roller 40, a uniform distribution of the existing wash solution being effected over the entire breadth of the soft cover 10 of the washing roller 2. The ink removed from the blanket cylinder 9, based upon the ink-division principle is taken over to the extent of about 50% thereof by the doctor roller 14 and is stripped off the latter by the rubber doctor blade 24.

When the rubber cloth covering of the blanket cylinder 1 is deemed by the operator to have been washed adequately clean, the lever 48 is then swung to the position "Drying" wherein, as shown in FIG. 2, the dirp tube 26 has been turned so far in clockwise direction by the indexing gear 65 and the swivel pinion 67, that no wash solution 29 can issue any longer from the nozzle openings 31.

Simultaneously, the valve 61 has been closed also by the indexing gear 65 and the adjusting pinion 64, so that no fresh wash solution 29 can flow any longer to the drip tube 26 through the feed tube 30. On the other hand, no wash solution can flow out of the drip tube 26 because the valve 61 keeps the feed tube 30 closed. In the setting "Drying" of the control lever 48, as shown in FIG. 2, the drip tube 26 has, in fact, been shifted so that no wash solution 29 is supplied any longer. Nevertheless, the entire washing device is in operative position e.g. the three rollers 2, 14 and 40 of the washing device continue to rotate. In the position "Drying," the washing device effects a rapid removal of the liquid from or drying of the previously moistened rubber cloth of the blanket cylinder 9. This drying cycle of the washing device permits not only a marked reduction in the washing time but also, moreover, an economizing of wash solution.

After completion of the drying operation, the control lever 48 is swung into the position "Off," wherein the nozzle openings 31, as shown in FIG. 3, point nearly vertically upwardly. During this control or indexing movement of the lever 48, the drip tube 26 is thus swiveled again in clockwise direction by the indexing gear 65 and the swivel pinion 67. Simultaneously, a rotation of the adjusting pinion 64 also occurs but does not effect any change in the setting of the valve 61. The valve 61 remains closed. The drip tube 26 remains filled with wash solution up to the nozzle openings 31 so that when swiveled into the washing setting it can again dispense wash solution.

With the pivoting of the control lever 48 into the control setting "Off," the adjusting member 34 has also been turned clockwise, whereby the cam follower 43 has dropped into a depression formed in the swivel cam 35, due to which the entire rocking frame 1, because of its own weight, swings away so far in clockwise direction as is permitted by the adjusting member 34. In this position the washing device is located in its swung-away neutral or rest position as shown in FIG. 3.

We claim:

1. In a washing device for an offset printing press having a blanket cylinder, the washing device being adjustable with respect to the blanket cylinder and including a rotary washing roller having a soft covering and being in frictional driving engagement with and traversible relative to the blanket cylinder, means for wetting the washing roller with wash solution, a collecting vessel underlying the washing roller, a doctor roller having a firm surface located in continuous frictional engagement with the washing roller, a doctor blade abutting the firm surface of the doctor roller for guiding therefrom into the collecting vessel ink washed off the blanket cylinder with the wash solution, and a distributor roller having a firm surface engaging the soft covering of the washing roller at a location behind the doctor roller in the rotary direction of the washing roller, the distributor roller being wettable with fresh wash solution; the means for wetting the washing roller with wash solution comprising a drip tube mounted above the distributor roller and extending along substantially the entire length thereof, said drip tube having a plurality of nozzles formed with nozzle openings, indexing means operatively connected to said drip tube for pivoting said tube about the longitudinal axis thereof into a plurality of indexing positions, and valve means similarly adjustable by said indexing means for regulating flow of the wash solution to the distributor roller in accordance with the respective indexing position of said drip tube.

2. Washing device according to claim 1 including indexing shaft means turnable about the longitudinal axis thereof, and an adjusting shaft for said valve means, and wherein said indexing means comprises three mutually meshing gears respectively mounted on said indexing shaft means, said adjusting shaft and said drip tube.

* * * * *